US012312934B2

(12) United States Patent
Zhao et al.

(10) Patent No.: US 12,312,934 B2
(45) Date of Patent: May 27, 2025

(54) WIRELESS REMOTE CONTROL METHOD AND SYSTEM FOR CONTROLLABLE ROTARY SLIDING GUIDING DRILLING

(71) Applicant: Chengdu University of Technology, Chengdu (CN)

(72) Inventors: Jianguo Zhao, Chengdu (CN); Qingyou Liu, Chengdu (CN); Haiyan Zhu, Chengdu (CN); Guorong Wang, Chengdu (CN); Jie Zeng, Chengdu (CN); Xu Luo, Chengdu (CN); Xuecheng Dong, Chengdu (CN); Xingming Wang, Chengdu (CN)

(73) Assignee: Chengdu University of Technology, Chengdu (CN)

( * ) Notice: Subject to any disclaimer, the term of this patent is extended or adjusted under 35 U.S.C. 154(b) by 0 days.

(21) Appl. No.: 18/470,510

(22) Filed: Sep. 20, 2023

(65) Prior Publication Data

US 2024/0093589 A1 Mar. 21, 2024

(30) Foreign Application Priority Data

Sep. 20, 2022 (CN) ..... 202211142360.6
Sep. 20, 2022 (CN) ..... 202211142482.5

(51) Int. Cl.
*E21B 44/00* (2006.01)
*E21B 7/04* (2006.01)
(Continued)

(52) U.S. Cl.
CPC ..... *E21B 44/00* (2013.01); *E21B 7/04* (2013.01); *E21B 21/10* (2013.01); *E21B 47/024* (2013.01); *E21B 47/06* (2013.01); *E21B 47/12* (2013.01)

(58) Field of Classification Search
CPC ..... E21B 44/00; E21B 44/005; E21B 44/02; E21B 44/04; E21B 44/06; E21B 44/08;
(Continued)

(56) References Cited

U.S. PATENT DOCUMENTS 5,390,153 A * 2/1995 Scherbatskoy ..... E21B 47/12 175/50
2009/0114445 A1* 5/2009 Dashevskiy ..... G01V 11/002 702/9

FOREIGN PATENT DOCUMENTS

CN 102383777 A 3/2012
CN 115387731 A 11/2022
(Continued)

*Primary Examiner* — Yanick A Akaragwe

(57) ABSTRACT

Disclosed are a wireless remote control method and system for controllable rotary sliding guiding drilling. An upper end of a controllable rotary sliding guiding drilling mechanism is provided with a drill rod; and the wireless remote control system for controllable rotary sliding guiding drilling further comprises: an MWD arranged at a lower end of the controllable rotary sliding guiding drilling mechanism; a bent screw drill tool mounted at a lower end of the MWD; a drill bit mounted at a lower end of the bent screw drill tool, the drill bit being connected with the bent screw drill tool through a connector; and a clutch module mounted on the controllable rotary sliding guiding drilling mechanism, the clutch module comprising an electromagnetic valve, a processor, an internal pipe pressure sensor, an external pipe pressure sensor and a wireless data transmission module.

4 Claims, 2 Drawing Sheets

(51) Int. Cl.

| | |
|---|---|
| ***E21B 21/10*** | (2006.01) |
| ***E21B 47/024*** | (2006.01) |
| ***E21B 47/06*** | (2012.01) |
| ***E21B 47/12*** | (2012.01) |

(58) Field of Classification Search
CPC ... E21B 44/10; E21B 7/04; E21B 7/06; E21B 7/10
See application file for complete search history.

(56) References Cited

FOREIGN PATENT DOCUMENTS

| | | | |
|---|---|---|---|
| CN | 115450563 | A | 12/2022 |
| CN | 115467651 | A | 12/2022 |

* cited by examiner

WIRELESS REMOTE CONTROL METHOD AND SYSTEM FOR CONTROLLABLE ROTARY SLIDING GUIDING DRILLING

CROSS REFERENCE TO RELATED APPLICATIONS

This application claims foreign priority of Chinese Patent Application No. 202211142360.6 with a filing date of Sep. 20, 2022, Chinese Patent Application No. 202211142482.5 with a filing date of Sep. 20, 2022. The content of the aforementioned applications, including any intervening amendments thereto, are incorporated herein by reference.

TECHNICAL FIELD

The present invention relates to the field of oil and natural gas drilling engineering technologies, and is particularly a wireless remote control method and system for controllable rotary sliding guiding drilling.

BACKGROUND OF THE PRESENT INVENTION

Horizontal well technology is a main technology to develop deep and unconventional oil and gas resources, horizontal well drilling needs borehole track guidance control, and at present, horizontal well guided drilling comprises rotary guidance and bent screw sliding guidance.

A bent screw sliding guiding technology is low in cost, so that horizontal well guidance in China is still dominated by bent screw sliding guidance. For example, in 2020, a proportion of the bent screw sliding guidance in Changqing dense oil and gas exceeded 90%. In the process of the bent screw sliding guidance, a drill string does not rotate, and large friction resistance of the drill string is very easy to cause a "backing pressure", leading to ineffective transmission of a bit pressure, and a rate of penetration is usually only 1/10 to 1/5 of that of rotary drilling. The "backing pressure" makes a tool face difficult to adjust and control, and drilling efficiency is reduced by more than 30%. Moreover, it is very easy to form a cuttings bed, leading to high adhesion and drill tool jamming risks.

At present, a drilling system with a signal transmission function, such as the patent with the publication number CN115653501A, titled controllable rotary sliding guiding drilling signal transmission and identification method and system, mainly comprises the following steps of: step 1: on the ground, setting a controllable rotary sliding guiding drill tool into two states of a state 0 (compound drilling) and a state 1 (rotary sliding guiding drilling); step 2: initializing the system into the state 0 before lowering, and lowering the drill tool into a bottom hole; step 3: when rotary sliding guiding drilling is needed, stopping rotating a top drive drilling system, adjusting a tool face angle of a bent screw, stopping a pump for 30 seconds to 60 seconds, setting the state 1, and controlling the controllable rotary sliding guiding drill tool to perform rotary sliding guiding drilling according to the target tool face angle by a measurement and control system; and step 4: when compound drilling is needed, stopping the pump for 30 seconds to 60 seconds, and setting the state 0 by the measurement and control system, or when a rotating speed is increased to R>5 r/min, setting the state 0 by the measurement and control system.

However, in the above systems, the measurement and control system mainly adopts a wired communication mode to realize signal connection, which is inconvenient to maintain. Therefore, we provide a wireless remote control method and system for controllable rotary sliding guiding drilling.

SUMMARY OF PRESENT INVENTION

The present invention aims to provide a wireless remote control method and system for controllable rotary sliding guiding drilling, so as to solve the problem proposed in the above background that an existing measurement and control system mainly adopts a wired communication mode to realize signal connection, which is inconvenient to maintain.

In order to achieve the object above, the present invention provides the following technical solution: a wireless remote control system for controllable rotary sliding guiding drilling comprises a controllable rotary sliding guiding drilling mechanism, wherein an upper end of the controllable rotary sliding guiding drilling mechanism is provided with a drill rod; and further comprises:

an MWD arranged at a lower end of the controllable rotary sliding guiding drilling mechanism;

a bent screw drill tool mounted at a lower end of the MWD;

a drill bit mounted at a lower end of the bent screw drill tool, wherein the drill bit is connected with the bent screw drill tool through a connector; and a clutch module mounted on the controllable rotary sliding guiding drilling mechanism, wherein the clutch module comprises an electromagnetic valve, a processor, an internal pipe pressure sensor, an external pipe pressure sensor and a wireless data transmission module, and the processor is bidirectionally connected with an overground system through the wireless data transmission module.

Preferably, output ends of the internal pipe pressure sensor and the external pipe pressure sensor are both electrically connected with an input end of the processor, an output end of the processor is electrically connected with an input end of the electromagnetic valve, and at least three electromagnetic valves are provided.

Preferably, a wireless remote control method for controllable rotary sliding guiding drilling comprises the following steps of:

S1: setting the controllable rotary sliding guiding drilling mechanism into two states of a state 0 and a state 1 by the overground system, wherein the state 0 refers to compound drilling and the state 1 refers to rotary sliding guiding drilling, writing a corresponding program into the processor, initializing the controllable rotary sliding guiding drilling mechanism to be in the state 0 before lowering, lowering the drill tool to a bottom hole, making a top drive drilling system rotate, and driving the drill bit to perform compound drilling;

S2: during drilling, emitting an oriented tool face angle A according to drilling requirements by the overground system, receiving a real-time tool face angle B measured by the MWD through the processor by the controllable rotary sliding guiding drilling mechanism, and feeding back information to the overground system through the wireless data transmission module;

S3: controlling to stop a pump for 30 seconds to 60 seconds by the overground system after receiving a signal, identifying an effective signal of stopping the pump for 30 seconds to 60 seconds by the processor, setting the controllable rotary sliding guiding drilling mechanism to be in the state 1, judging an angle change rate based on an angle difference between the oriented tool face angle A and the real-time tool face angle B in combination with a numerical value of the real-time tool face angle B by taking the oriented tool face angle A as a target through the processor at the same time, and distributing a clutching frequency N to the clutch module;

S4: controlling the electromagnetic valve to be turned on and off based on the distributed clutching frequency N by the processor, so as to control high-pressure mud and low-pressure mud to alternately enter a hydraulic chamber, and realize clutching control, so that upper rotation is isolated from lower torsion in the controllable rotary sliding guiding drill tool, controlling the bent screw drill tool to perform rotary sliding guiding drilling according to the target tool face angle $A \pm \Delta\gamma$, and identifying a running state according to an internal and external pipe pressure difference by the external pipe pressure sensor and the internal pipe pressure sensor at the moment; and S5: when compound drilling is needed, stopping the pump for 30 seconds to 60 seconds, identifying the effective signal of stopping the pump 30 seconds to 60 seconds by the processor, and adjusting the controllable rotary sliding guiding drilling mechanism to be converted from the state 1 into the state 0 to perform compound drilling.

Preferably, in the S3 and the S5, the running state of the pump is identified by the external pipe pressure sensor and the internal pipe pressure sensor according to the internal and external pipe pressure difference, so as to judge whether the pump is stopped.

Preferably, in the S3, when $|A-B|<\Delta\gamma$, the processor judges that the adjustment of the tool face angle is completed.

Preferably, in the S1, the state 0 and the state 1 are opposite to each other, when the controllable rotary sliding guiding drilling mechanism is in the state 0, and the processor identifies the signal of stopping the pump for 30 seconds to 60 seconds, the controllable rotary sliding guiding drilling mechanism is converted to be in the state 1; and when the controllable rotary sliding guiding drilling mechanism is in the state 1, and the processor identifies the signal of stopping the pump for 30 seconds to 60 seconds, the controllable rotary sliding guiding drilling mechanism is converted to be in the state 0.

Preferably, in the S4, the electromagnetic valve is turned on and off at an interval of 10 ms to 50 ms, which reduces an instantaneous overload current of the system, thus protecting a circuit from being burnt out by the overload current.

Compared with the prior art, the present invention has the following beneficial effects.

1. According to the present invention, the processor and the wireless data transmission module are arranged in the processor of the controllable rotary sliding guiding drilling mechanism, the processor is bidirectionally connected with the overground system through the wireless data transmission module, the overground system emits the oriented tool face angle A according to the drilling requirements, the controllable rotary sliding guiding drilling mechanism receives the real-time tool face angle B measured by the MWD through the processor and feeds back the information to the overground system through the wireless data transmission module, the overground system sets the controllable rotary sliding guiding drilling mechanism to be in the state 1 after receiving the signal, when the compound drilling is needed, the overground system remotely sends the signal to the processor of the controllable rotary sliding guiding drilling mechanism, so that the controllable rotary sliding guiding drilling mechanism 1 is set to be in the state 0, and wireless signal transmission is adopted, so that the control is convenient, a wire control interference is avoided, and the maintenance is convenient, thus solving the problem in the existing system that the measurement and control system mainly adopts a wired communication mode to realize signal connection, which is inconvenient to maintain.

2. A signal capacity is small, and there are only two signal modes of 0 and 1 for control, so that the system has a low maintenance cost and high reliability.

3. According to the present invention, the angle change rate is judged based on the angle difference between the oriented tool face angle A and the real-time tool face angle B in combination with the numerical value of the real-time tool face angle B by taking the oriented tool face angle A as the target through the processor, the clutching frequency N is distributed to the clutch module, and a clutch is controlled to be turned on and off through a plurality of electromagnetic valves, which means that the high-pressure mud and the low-pressure mud are controlled to alternately enter the hydraulic chamber, and clutching control is realized, so that compared with traditional double-clutch reciprocating control, single-clutch multi-electromagnetic forward and reverse rotation control saves cost and can be adjusted into the target angle more directly at the same time.

Figure 1:
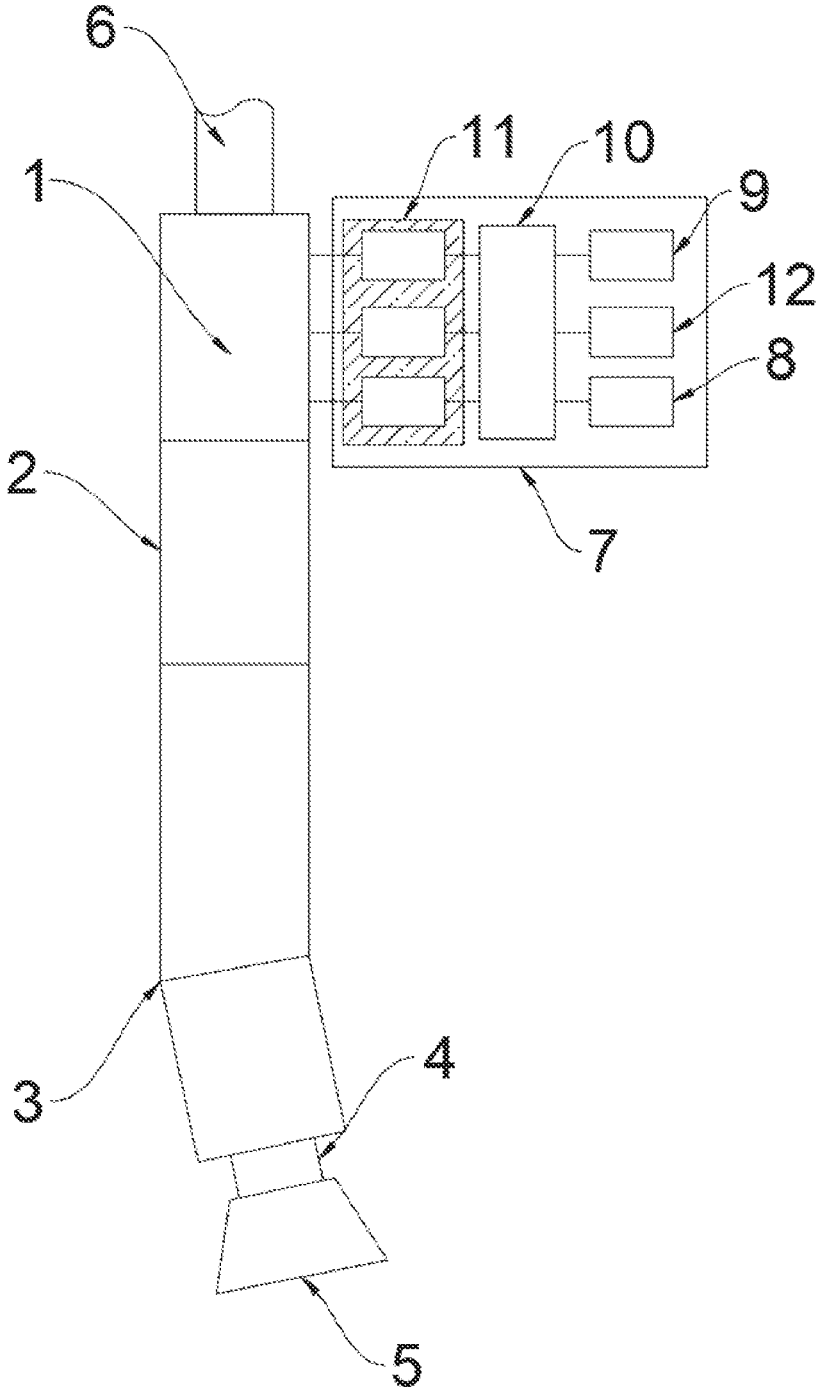
FIG. 1 is a schematic diagram of an overall structure of the present invention.

In the drawings: 1 refers to controllable rotary sliding guiding drilling mechanism; 2 refers to MWD; 3 refers to bent screw drill tool; 4 refers to connector; 5 refers to drill bit; 6 refers to drill rod; 7 refers to clutch module; 8 refers to wireless data transmission module; 9 refers to external pipe pressure sensor; 10 refers to processor; 11 refers to electromagnetic valve; and 12 refers to internal pipe pressure sensor.

DETAILED DESCRIPTION OF PREFERRED EMBODIMENTS

The technical solutions in the embodiments of the present invention are clearly and completely described hereinafter with reference to the drawings in the embodiments of the present invention. Obviously, the described embodiments are merely some but not all of the embodiments of the present invention.

Figure 2:
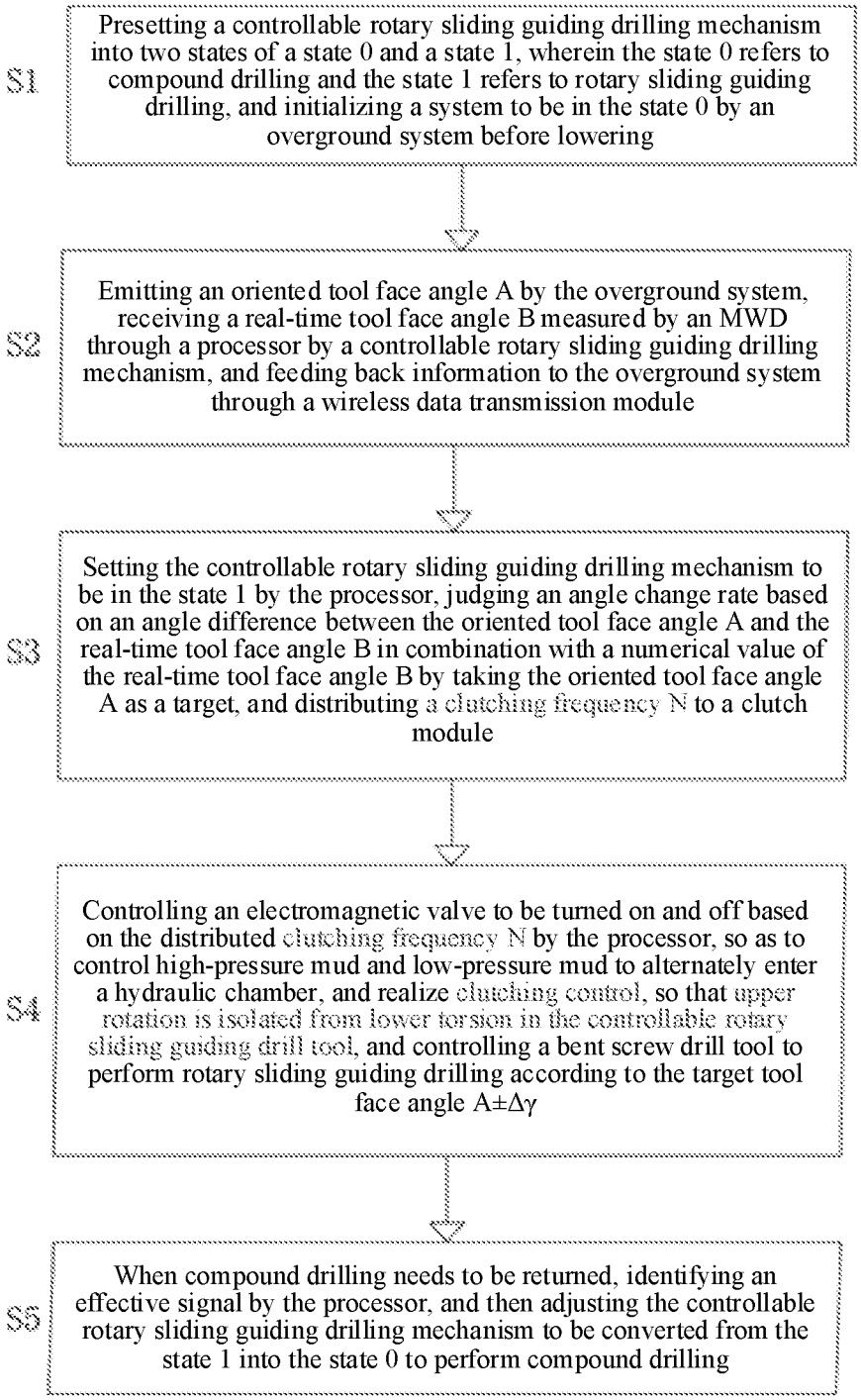
FIG. 2 is a flow chart of a method of the present invention.

With reference to FIG. 1 to FIG. 2, the present invention provides an embodiment: a wireless remote control system for controllable rotary sliding guiding drilling comprises a controllable rotary sliding guiding drilling mechanism 1, wherein an upper end of the controllable rotary sliding guiding drilling mechanism 1 is provided with a drill rod 6; and further comprises:

an MWD 2 arranged at a lower end of the controllable rotary sliding guiding drilling mechanism 1;

a bent screw drill tool 3 mounted at a lower end of the MWD 2;

a drill bit 5 mounted at a lower end of the bent screw drill tool 3, wherein the drill bit 5 is connected with the bent screw drill tool 3 through a connector 4; and a clutch module 7 mounted on the controllable rotary sliding guiding drilling mechanism 1, wherein the clutch module 7 comprises an electromagnetic valve 11, a processor 10, an internal pipe pressure sensor 12, an external pipe pressure sensor 9 and a wireless data transmission module 8, and the processor 10 is bidirectionally connected with an overground system through the wireless data transmission module 8.

With reference to FIG. 1, output ends of the internal pipe pressure sensor 12 and the external pipe pressure sensor 9 are both electrically connected with an input end of the processor 10, an output end of the processor 10 is electrically connected with an input end of the electromagnetic valve 11, and at least three electromagnetic valves 11 are provided.

With reference to FIG. 1 to FIG. 2, a wireless remote control method for controllable rotary sliding guiding drilling comprises the following steps of:

S1: setting the controllable rotary sliding guiding drilling mechanism 1 into two states of a state 0 and a state 1 by the overground system, wherein the state 0 refers to compound drilling and the state 1 refers to rotary sliding guiding drilling, writing a corresponding program into the processor 10, initializing the controllable rotary sliding guiding drilling mechanism 1 to be in the state 0 before lowering, lowering the drill tool to a bottom hole, making a top drive drilling system rotate, and driving the drill bit (6) to perform compound drilling;

S2: during drilling, emitting an oriented tool face angle A according to drilling requirements by the overground system, receiving a real-time tool face angle B measured by the MWD 2 through the processor 10 by the controllable rotary sliding guiding drilling mechanism 1, and feeding back information to the overground system through the wireless data transmission module 8;

S3: controlling to stop a pump for 30 seconds to 60 seconds by the overground system after receiving a signal, identifying an effective signal of stopping the pump for 30 seconds to 60 seconds by the processor 10, setting the controllable rotary sliding guiding drilling mechanism 1 to be in the state 1, judging an angle change rate based on an angle difference between the oriented tool face angle A and the real-time tool face angle B in combination with a numerical value of the real-time tool face angle B by taking the oriented tool face angle A as a target through the processor at the same time, and distributing a clutching frequency N to the clutch module 7;

S4: controlling the electromagnetic valve 11 to be turned on and off based on the distributed clutching frequency N by the processor 10, so as to control high-pressure mud and low-pressure mud to alternately enter a hydraulic chamber, and realize clutching control, so that upper rotation is isolated from lower torsion in the controllable rotary sliding guiding drill tool 4, controlling the bent screw drill tool 3 to perform rotary sliding guiding drilling according to the target tool face angle $A \pm \Delta\gamma$, and identifying a running state according to an internal and external pipe pressure difference by the external pipe pressure sensor 9 and the internal pipe pressure sensor 12 at the moment; and S5: when compound drilling is needed, stopping the pump for 30 seconds to 60 seconds, identifying the effective signal of stopping the pump 30 seconds to 60 seconds by the processor 10, and adjusting the controllable rotary sliding guiding drilling mechanism 1 to be converted from the state 1 into the state 0 to perform compound drilling.

Further, in the S3 and the S5, the running state of the pump is identified by the external pipe pressure sensor 9 and the internal pipe pressure sensor 12 according to the internal and external pipe pressure difference, so as to judge whether the pump is stopped.

Further, in the S3, when $|A-B|<\Delta\gamma$, the processor 10 judges that the adjustment of the tool face angle is completed.

Further, in the S1, the state 0 and the state 1 are opposite to each other, when the controllable rotary sliding guiding drilling mechanism 1 is in the state 0, and the processor 10 identifies the signal of stopping the pump for 30 seconds to 60 seconds, the controllable rotary sliding guiding drilling mechanism 1 is converted to be in the state 1; and when the controllable rotary sliding guiding drilling mechanism 1 is in the state 1, and the processor 10 identifies the signal of stopping the pump for 30 seconds to 60 seconds, the controllable rotary sliding guiding drilling mechanism 1 is converted to be in the state 0.

Further, in the S4, the electromagnetic valve 11 is turned on and off at an interval of 10 ms to 50 ms, which reduces an instantaneous overload current of the system, thus protecting a circuit from being burnt out by the overload current.

It is apparent for those skilled in the art that the present invention is not limited to the details of the above exemplary embodiments, and the present invention can be realized in other specific forms without departing from the spirit or basic characteristics of the present invention. Therefore, the embodiments should be regarded as being exemplary and non-limiting from any point of view, and the scope of the present invention is defined by the appended claims rather than the above description, so that it is intended to comprise all changes falling within the meaning and range of equivalent elements of the claims. Any reference numerals in the claims should not be regarded as limiting the claims involved.

We claim:

1. A wireless remote control method for controllable rotary sliding guiding drilling, comprising the following steps of:

S1: setting a controllable rotary sliding guiding drilling mechanism (1) into two states of a state 0 and a state 1, wherein the state 0 refers to drilling and the state 1 refers to rotary sliding guiding drilling, writing a corresponding program into a processor (10), initializing the controllable rotary sliding guiding drilling mechanism (1) to be in the state 0 before lowering, lowering a drill tool to a bottom hole, and driving a drill bit (6) to perform drilling;

S2: during drilling, emitting an oriented tool face angle A according to drilling requirements, receiving a real-time tool face angle B measured by a MWD (2) through the processor (10) by the controllable rotary sliding guiding drilling mechanism (1), and feeding back information through a wireless data transmission module (8);

S3: controlling to stop a pump for 30 seconds to 60 seconds after receiving a signal, identifying an effective signal of stopping the pump for 30 seconds to 60 seconds by the processor (10), setting the controllable rotary sliding guiding drilling mechanism (1) to be in the state 1, judging an angle change rate based on an angle difference between the oriented tool face angle A and the real-time tool face angle B in combination with a numerical value of the real-time tool face angle B by setting the oriented tool face angle A as a target value in the processor, and distributing a clutching frequency N to a clutch module (7);

S4: controlling an electromagnetic valve (11) to be turned on and off based on the distributed clutching frequency N by the processor (10), controlling a bent screw drill tool (3) to perform rotary sliding guiding drilling according to a target tool face angle, and identifying a running state according to an internal and external pipe pressure difference by an external pipe pressure sensor (9) and an internal pipe pressure sensor (12); and S5: when drilling is needed, stopping the pump for 30 seconds to 60 seconds, identifying the effective signal of stopping the pump 30 seconds to 60 seconds by the processor (10), and adjusting the controllable rotary sliding guiding drilling mechanism (1) to be converted from the state 1 into the state 0 to perform drilling; and wherein, the wireless remote control method for controllable rotary sliding guiding drilling is realized on the basis of a wireless remote control system for controllable rotary sliding guiding drilling, and the wireless remote control system for controllable rotary sliding guiding drilling comprises:

the controllable rotary sliding guiding drilling mechanism (1), wherein an upper end of the controllable rotary sliding guiding drilling mechanism (1) is provided with a drill rod (6); and further comprising:

the MWD (2) arranged at a lower end of the controllable rotary sliding guiding drilling mechanism (1);

the bent screw drill tool (3) mounted at a lower end of the MWD (2);

the drill bit (5) mounted at a lower end of the bent screw drill tool (3), wherein the drill bit (5) is connected with the bent screw drill tool (3) through a connector (4); and the clutch module (7) mounted on the controllable rotary sliding guiding drilling mechanism (1), wherein the clutch module (7) comprises the electromagnetic valve (11), the processor (10), the internal pipe pressure sensor (12), the external pipe pressure sensor (9) and the wireless data transmission module (8);

output ends of the internal pipe pressure sensor (12) and the external pipe pressure sensor (9) are both electrically connected with an input end of the processor (10), an output end of the processor (10) is electrically connected with an input end of the electromagnetic valve (11), and at least three electromagnetic valves (11) are provided.

2. The wireless remote control method for controllable rotary sliding guiding drilling according to claim 1, wherein in S3 and S5, the running state of the pump is identified by the external pipe pressure sensor (9) and the internal pipe pressure sensor (12) according to the internal and external pipe pressure difference.

3. The wireless remote control method for controllable rotary sliding guiding drilling according to claim 1, wherein in S1, the state 0 and the state 1 are opposite to each other, when the controllable rotary sliding guiding drilling mechanism (1) is in the state 0, and the processor (10) identifies the signal of stopping the pump for 30 seconds to 60 seconds, the controllable rotary sliding guiding drilling mechanism (1) is converted to be in the state 1; and when the controllable rotary sliding guiding drilling mechanism (1) is in the state 1, and the processor (10) identifies the signal of stopping the pump for 30 seconds to 60 seconds, the controllable rotary sliding guiding drilling mechanism (1) is converted to be in the state 0.

4. The wireless remote control method for controllable rotary sliding guiding drilling according to claim 3, wherein in S4, the electromagnetic valve (11) is turned on and off at an interval of 10 ms to 50 ms.

* * * * *